US009090952B2

(12) United States Patent
Makimizu et al.

(10) Patent No.: US 9,090,952 B2
(45) Date of Patent: Jul. 28, 2015

(54) HIGH-STRENGTH COLD-ROLLED STEEL SHEET AND METHOD FOR PRODUCING THE SAME

(75) Inventors: Yoichi Makimizu, Fukuyama (JP); Yoshitsugu Suzuki, Fukuyama (JP); Mai Miyata, Fukuyama (JP); Naoto Yoshimi, Kawasaki (JP); Junichiro Hirasawa, Chiba (JP); Shinji Otsuka, Fukuyama (JP); Hideki Nagano, Fukuyama (JP); Kohei Hasegawa, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 312 days.

(21) Appl. No.: 13/517,417

(22) PCT Filed: Dec. 24, 2010

(86) PCT No.: PCT/JP2010/073877

§ 371 (c)(1), (2), (4) Date: Sep. 6, 2012

(87) PCT Pub. No.: WO2011/078412

PCT Pub. Date: Jun. 30, 2011

(65) Prior Publication Data

US 2012/0325376 A1 Dec. 27, 2012

(30) Foreign Application Priority Data

Dec. 25, 2009 (JP) ..... 2009-293919

(51) Int. Cl.

| | |
|---|---|
| ***C23C 8/14*** | (2006.01) |
| ***C22C 38/02*** | (2006.01) |
| ***C21D 1/74*** | (2006.01) |
| ***C21D 1/76*** | (2006.01) |
| ***C21D 9/46*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |
| ***C22C 38/18*** | (2006.01) |
| ***C23C 22/78*** | (2006.01) |
| ***C23C 8/02*** | (2006.01) |
| ***C23C 8/80*** | (2006.01) |
| ***C22C 38/00*** | (2006.01) |
| ***C21D 6/00*** | (2006.01) |
| *C23C 8/10* | (2006.01) |

(52) U.S. Cl.

CPC .. *C21D 1/74* (2013.01); *C21D 1/76* (2013.01); *C21D 6/005* (2013.01); *C21D 9/46* (2013.01); *C22C 38/001* (2013.01); *C22C 38/02* (2013.01); *C22C 38/04* (2013.01); *C22C 38/06* (2013.01); *C22C 38/12* (2013.01); *C22C 38/14* (2013.01); *C22C 38/18* (2013.01); *C23C 8/02* (2013.01); *C23C 8/14* (2013.01); *C23C 8/80* (2013.01); *C23C 22/78* (2013.01)

(58) Field of Classification Search

CPC ..... C23C 8/10; C23C 8/12; C23C 8/14; C23C 8/16; C23C 8/18; C21D 8/02; C21D 1/74; C21D 9/46; C22C 38/02; C22C 38/04; C22C 38/12; C22C 38/18

See application file for complete search history.

(56) References Cited

FOREIGN PATENT DOCUMENTS

| | | | |
|---|---|---|---|
| JP | 55-145122 | A | 11/1980 |
| JP | 9-310148 | | 12/1997 |
| JP | 2003-113441 | | 4/2003 |
| JP | 2004-323969 | A | 11/2004 |
| JP | 2006-045615 | A | 2/2006 |
| JP | 2006-265586 | A | 10/2006 |
| JP | 2007-084868 | A | 4/2007 |
| JP | 2008-069445 | A | 3/2008 |
| JP | 2008-266778 | A | 11/2008 |

OTHER PUBLICATIONS

International Search Report dated Mar. 22, 2011, application No. PCT/JP2010/073877.

*Primary Examiner* — Lois Zheng
(74) *Attorney, Agent, or Firm* — RatnerPrestia

(57) ABSTRACT

A high-strength cold-rolled steel sheet having high chemical convertibility and a tensile strength of 590 MPa or more and a method for producing such a steel sheet are provided. The steel sheet contains, in terms of percent by mass, C: 0.05 to 0.3%, Si: 0.6 to 3.0%, Mn: 1.0 to 3.0%, P: 0.1% or less, S: 0.05% or less, Al: 0.01 to 1%, N: 0.01% or less, and the balance being Fe and unavoidable impurities. The coverage ratio of reduced iron on a steel sheet surface is 40% or more. In order to produce such a steel sheet, an oxidation treatment is performed after cold rolling. Subsequently, annealing is conducted in a furnace in a 1 to 10 vol % $H_2$+balance $N_2$ gas atmosphere with a dew point of −25° C. or less.

16 Claims, No Drawings

HIGH-STRENGTH COLD-ROLLED STEEL SHEET AND METHOD FOR PRODUCING THE SAME

CROSS REFERENCE TO RELATED APPLICATION

This application is the U.S. National Phase application of PCT International Application No. PCT/JP2010/073877, filed Dec. 24, 2010, and claims priority to Japanese Patent Application No. 2009-293919, filed Dec. 25, 2009, the disclosure of both are incorporated herein by reference in their entireties for all purposes.

FIELD OF THE INVENTION

The present invention relates to automobile-use high-strength cold-rolled steel sheets which are to be subjected to a chemical conversion treatment such as phosphating and to painting, and to a method for producing such cold-rolled steel sheets. In particular, aspects of the invention relate to a high-strength cold-rolled steel sheet that exhibits a tensile strength of 590 MPa or more due to a strengthening effect of Si, and high chemical convertibility, and to a method for producing such a cold-rolled steel sheet.

BACKGROUND OF THE INVENTION

In recent years, demand for cold-rolled steel sheets having a high strength such as a tensile strength of 590 MPa or more has increased to comply with the trends toward automobile weight-reduction. Automobile-use cold-rolled steel sheets are painted and, prior to painting, a chemical conversion treatment such as phosphating is performed. The chemically conversion treatment to the cold-rolled steel sheet is one of the key processes for yielding corrosion resistance after painting.

Addition of Si effectively increases the strength of cold-rolled steel sheets. However, in steel sheets (high-strength cold-rolled steel sheets) containing Si, oxidation of Si occurs even in a reducing $N_2$+$H_2$ gas atmosphere that does not oxidize Fe (in other words, that reduces Fe oxides) during continuous annealing, and a thin film of a Si oxide ($SiO_2$) is formed on the outermost surface of steel sheets. Since this Si oxide ($SiO_2$) thin film inhibits the reaction for generating chemical conversion coatings during the chemical conversion treatment, micro regions in which no chemical conversion coatings are formed (hereinafter these regions are also referred to as "uncovered regions") are generated and the chemical convertibility is degraded.

Patent Literature 1 describes a related art for improving the chemical convertibility of high-strength cold-rolled steel sheets, which is a method that includes controlling a steel sheet temperature to 350° C. to 650° C. in an oxidizing atmosphere to form an oxide film on a steel sheet surface, heating the steel sheet to a recrystallization temperature in a reducing atmosphere, and cooling the steel sheet.

Patent Literature 2 describes a method that includes forming an oxide film on a surface of a cold-rolled steel sheet in an iron-oxidizing atmosphere at a steel sheet temperature of 400° C. or higher, the cold-rolled steel sheet containing, in terms of mass %, 0.1% or more of Si and/or 1.0% or more of Mn, and then reducing the oxide film on the steel sheet surface in an iron-reducing atmosphere.

Patent Literature 3 describes a high-strength cold-rolled steel sheet in which oxides effective for improving chemical convertibility and other properties are contained in a crystal grain boundary and/or inside a crystal grain on a high-strength cold-rolled steel sheet surface layer containing 0.1 wt % or more and 3.0 wt % or less of Si. Patent Literature 4 describes a steel sheet having high phosphatability, in which, when a cross-section taken in a direction orthogonal to the steel sheet surface is observed with an electron microscope at a 50000× magnification or more and the ratio of the Si-containing oxides in a steel sheet surface length of 10 μm is determined at five positions arbitrarily selected, the average ratio is 80% or less. Patent Literature 5 describes a high-strength cold-rolled steel sheet having high chemical convertibility and containing, in terms of mass %, C: more than 0.1% and Si: 0.4% or more, in which the Si content (mass %)/Mn content (mass %) is 0.4 or more, the tensile strength is 700 MPa or more, the surface coverage ratio of Si-based oxides mainly composed of Si on the steel sheet surface is 20 area % or less, and the diameter of the maximum inscribed circle inscribing a region covered with the Si-based oxides is 5 μm or less. Patent Literature 6 describes a high-tensile strength steel sheet having high chemical convertibility containing, in terms of mass %, C: 0.01 to 0.30, Si: 0.2 to 3.00, Mn: 0.1 to 3.0%, and Al: 0.01 to 2.0% and having a tensile strength of 500 MPa or more, in which the average grain diameter of crystal grains on the steel sheet surface is 0.5 win or less; and when an observation region 10 μm or wider is sliced from the steel sheet surface to prepare a thin sample for cross-sectional TEM observation and the sliced thin sample is measured by TEM observation under conditions that enable observation of oxides 10 nm or smaller, the ratio of oxide species containing a total of 70 mass % or more of one or both of a silicon oxide and manganese silicate relative to the grain boundary region surface in the cross-section is 30% or less and the grain diameter of the oxide species present in a range of 0.1 to 1.0 μm in depth from the steel sheet surface is 0.1 μm or less.

PATENT LITERATURE

PTL 1: Japanese Unexamined Patent Application Publication No. 55-145122

PTL 2: Japanese Unexamined Patent Application Publication No. 2006-45615

PTL 3: Japanese Patent No. 3386657

PTL 4: Japanese Patent No. 3840392

PTL 5: Japanese Unexamined Patent Application Publication No. 2004-323969

PTL 6: Japanese Unexamined Patent Application Publication No. 2008-69445

SUMMARY OF THE INVENTION

In the production method described in Patent Literature 1, the thickness of the oxide film formed on a steel sheet surface may vary depending on the oxidation method, resulting in insufficient oxidation or may become excessively large, thereby causing the oxide film to remain or separate during the subsequent annealing in a reducing atmosphere and leading to degradation of surface properties. Although a technique of conducting oxidation in air is described in Examples, oxidation in air produces a thick oxide layer, which makes the subsequent reduction difficult or requires a reducing atmosphere with a high hydrogen concentration.

The production method described in Patent Literature 2 is a method that includes oxidizing Fe on a steel sheet surface by using a direct firing burner with an air ratio of 0.93 or more and 1.10 or less at 400° C. or higher and then annealing the steel sheet in a $N_2$+$H_2$ gas atmosphere that reduces Fe oxides so as to suppress generation of $SiO_2$, which degrades the chemical convertibility, on the outermost surface and to form a reduced Fe layer on the outermost surface. Patent Literature 2 does not specifically describe the heating temperature of the direct firing burner. However, when a large amount of Si (0.6% or more) is incorporated, the amount of oxidation of Si, which is more readily oxidizable than Fe, increases, thereby suppressing oxidation of Fe, or less oxidation of Fe itself occurs. As a result, a reduced iron surface layer after the reduction may not be sufficiently formed, $SiO_2$ may remain on the reduced steel sheet surface, and portions not covered with chemical conversion coatings may occur.

The steel sheet of Patent Literature 3 is a steel sheet that has chemical convertibility improved by inducing Si oxides to form inside the steel sheet and thereby eliminating Si oxides from the surface. The production method involves coiling a steel sheet at a high temperature (a temperature of 620° C. or higher is favored in Examples) after hot-rolling which precedes cold rolling so that the heat thereof can be used to induce formation of Si oxides inside the steel sheet. However, since the cooling rate is high at the outer side of the coil and low at the inner side, the temperature in the steel sheet longitudinal direction greatly varies and it is difficult to obtain a uniform surface quality over the entire length of the coil.

Patent Literatures 4, 5, and 6 each describe a steel sheet in which the upper limit of the amount of the Si oxide coating the surface is specified although the way they specify it is different from one another. The production method includes controlling the dew point of a reducing $N_2$+$H_2$ gas atmosphere (in other words, the ratio (steam partial pressure/hydrogen partial pressure) which is hereinafter may be referred to as a "steam-hydrogen partial pressure ratio") to be within a particular range during heating or soaking in continuous annealing so as to oxidize Si inside the steel sheet. The range of the dew point is described as −25° C. or higher in Patent Literature 4 and from −20° C. to 0° C. in Patent Literature 5. In Patent Literature 6, a method of controlling the range of the steam-hydrogen partial pressure ratio separately in the steps of preheating, heating, and recrystallization is employed. In these methods, the dew point of the $N_2$+$H_2$ gas atmosphere, which usually has a dew point of −25° C. or less, is preferably controlled to a higher temperature by, for example, introducing steam or air. However, this poses a problem on the operation controllability, resulting in failure to stably obtain high chemical convertibility. Moreover, increasing the dew point (or increasing the steam-hydrogen partial pressure ratio) increases the oxidizing property of the atmosphere, possibly resulting in accelerated deterioration of furnace walls and in-furnace rolls and generation of scale defects called pickup defects on steel sheet surfaces.

Under these circumstances, aspects of the present invention provide a high-strength cold-rolled steel sheet containing 0.6% or more of Si and having high chemical convertibility and a tensile strength of 590 MPa or more, the steel sheet being made without controlling the dew point or the steam-hydrogen partial pressure ratio of the reducing atmosphere in a soaking furnace, and a method for producing such a steel sheet.

The inventors of the present invention have conducted extensive studies and found the following.

The chemical convertibility of a high-strength cold-rolled steel sheet containing 0.6% or more of Si can be improved by controlling the oxidation amounts of oxides after an oxidation treatment and the coverage of reduced iron ultimately formed on a surface.

In order to conduct such control, the oxygen concentration in the atmosphere during the oxidation treatment is controlled. As a result, a high-strength cold-rolled steel sheet having improved chemical convertibility can be produced, which has a tensile strength (hereinafter may be referred to as "TS") of 590 MPa or more and a strength-elongation balance (hereinafter may be referred to as TS×El) of 18000 MPa·% or more.

The present invention has been made on at least the basis of the aforementioned findings and aspects of the present invention are summarized as follows:

[1] A high-strength cold-rolled steel sheet including, in terms of percent by mass, a composition of C: 0.05 to 0.30%, Si: 0.6 to 3.0%, Mn: 1.0 to 3.0%, P: 0.1% or less, S: 0.05% or less, Al: 0.01 to 1%, N: 0.01% or less, and the balance being Fe and unavoidable impurities, wherein a coverage ratio of reduced iron on a steel sheet surface is 40% or more.

[2] The high-strength cold-rolled steel sheet according to [1] further including, in terms of percent by mass, at least one of Cr: 0.01 to 1%, Mo: 0.01 to 1%, Ni: 0.01 to 1%, and Cu: 0.01 to 1%.

[3] The high-strength cold-rolled steel sheet according to [1] or [2], further including, in terms of percent by mass, at least one of Ti: 0.001 to 0.1%, Nb: 0.001 to 0.1%, and V: 0.001 to 0.1%.

[4] The high-strength cold-rolled steel sheet according to any one of [1] to [3], further including, in terms of percent by mass, B: 0.0003 to 0.005%.

[5] A method for producing a high-strength cold-rolled steel sheet, including sequentially conducting hot-rolling, pickling, cold-rolling, an oxidation treatment, and annealing on steel having the composition described in any one of claims 1 to 4, wherein, in the oxidation treatment, first heating is conducted on a steel sheet in an atmosphere with an oxygen concentration of 1000 ppm or more until a steel sheet temperature reaches 630° C. or higher, and second heating is conducted on the steel sheet in an atmosphere with an oxygen concentration of less than 1000 ppm until a steel sheet temperature reaches 700° C. or higher; and in the annealing, soaking is conducted in a furnace in a 1 to 10 vol $H_2$+balance $N_2$ gas atmosphere with a dew point of −25° C. or less.

[6] The method for producing a high-strength cold-rolled steel sheet according to [5], in which the second heating in the oxidation treatment is carried out at a steel sheet temperature of 800° C. or less.

[7] The method for producing a high-strength cold-rolled steel sheet according to [5] or [6], in which, after the hot-rolling, the steel sheet is coiled at a coiling temperature of 520° C. or higher.

[8] The method for producing a high-strength cold-rolled steel sheet according to [5] or [6], in which, after the hot-rolling, the steel sheet is coiled at a coiling temperature of 580° C. or higher.

In this description, % expressing the composition of the steel denotes percent by mass. As used herein, a "high-strength cold-rolled steel sheet" refers to a cold-rolled steel sheet having a tensile strength TS of 590 MPa or more.

According to aspects of the present invention, a high-strength cold-rolled steel sheet having a tensile strength of 590 MPa or more and high chemical convertibility is obtained. Moreover, the high-strength cold-rolled steel sheet of aspects of the present invention has high workability, i.e., TS×El of 18000 MPa·% or more.

Furthermore, since a high-strength cold-rolled steel sheet having high chemical convertibility and a tensile strength of 590 MPa or more is obtained without controlling the dew point to be high, aspects of the invention provide an advantage regarding operation controllability. Moreover, problems such as accelerated deterioration of furnace walls and in-furnace rolls and generation of scale defects called pickup defects on steel sheet surfaces can be addressed.

DETAILED DESCRIPTION OF THE INVENTION

Embodiments of the present invention will now be described in detail.

First, the reasons for the limitations imposed on the chemical composition of a steel sheet targeted by aspects of the present invention are described. Note that "%" describing the components denotes percent by mass unless otherwise noted.

C: 0.05 to 0.3%

Carbon is used to control the metal microstructure so that ferrite-martensite, ferrite-bainite-residual austenite, or the like is formed, and has a solid-solution-strengthening property and a martensite-generating property required to obtain a desired material. In order to achieve these effects, the C content is preferably 0.05% or more. Preferably, the C content is 0.10% or more. When carbon is added in an excessively large amount, the workability of the steel sheet decreases significantly. Thus the upper limit is 0.3%. Si: 0.6 to 3.0%

Silicon is an element that increases the strength of a steel sheet without decreasing the workability. In order to achieve such an effect, the Si content is preferably 0.6% or more. At a Si content less than 0.6%, the workability, i.e., TS×El, is deteriorated. The Si content is preferably more than 1.10%. However, at a Si content exceeding 3.0%, significant embrittlement occurs in the steel sheet, and the workability and the chemical convertibility are degraded. Thus, the upper limit is 3.0%.

Mn: 1.0 to 3.0%

Manganese is used to control the metal microstructure so that ferrite-martensite, ferrite-bainite-residual austenite, or the like is formed, and has a solid-solution-strengthening property and a martensite-generating property required to obtain a desired material. In order to achieve these effects, the Mn content is preferably 1.0% or more. When an excessively large amount of Mn is added, the workability of the steel sheet is significantly degraded. Thus, the upper limit is 3.0%.

P: 0.1% or less

Phosphorus is an element that is effective for strengthening steel. At a P content exceeding 0.1%, embrittlement occurs due to grain boundary segregation, resulting in deterioration of impact resistance as well as corrosion resistance. Thus, the P content is 0.1% or less and preferably 0.015% or less.

S: 0.05% or less

Sulfur forms inclusions such as MnS and degrades impact resistance, causes cracking along the metal flow of welded portions, and deteriorates the corrosion resistance. The S content is preferably reduced as much as possible and is 0.05% or less and preferably 0.003% or less.

Al: 0.01 to 1%

Aluminum is added as a deoxidizer. At an Al content less than 0.01%, the deoxidizing effect is not sufficient. At an Al content exceeding 1%, the deoxidizing effect is saturated, which is uneconomical. Accordingly, the Al content is 0.01% or more and 1% or less.

N: 0.01% or less

Nitrogen is the element that most significantly deteriorates the aging resistance of steel. Thus, the N content is preferably reduced as much as possible and is 0.01% or less.

The balance is Fe and unavoidable impurities.

The steel sheet may contain, in addition to the components described above, at least one of Cr: 0.01 to 1%, Mo: 0.01 to 1%, Ni: 0.01 to 1%, and Cu: 0.01 to 1% to improve the strength-ductility balance.

In order to increase the strength of the steel sheet, the steel sheet may contain at least one of Ti: 0.001 to 0.1%, Nb: 0.001 to 0.1%, and V: 0.001 to 0.1%.

In order to increase the strength of the steel sheet and the strength after paint baking, the steel sheet may contain 0.0003 to 0.005% of B.

The oxides and the oxidation amount after the oxidation treatment and the coverage ratio of reduced steel on a final steel sheet surface after annealing are described next.

When annealing follows the oxidation treatment, iron oxides formed by the oxidation treatment are reduced in the annealing step and form reduced iron that covers the cold-rolled steel sheet. For the purposes of the present application, reduced iron refers to iron oxides that are reduced in the above manner. Reduced iron formed in this way contains smaller concentrations of elements, such as Si, that inhibit chemical convertibility. For example, the Si concentration in the reduced iron is lower than the Si concentration in the steel sheet. Accordingly, coating the steel sheet surface with the reduced iron is particularly effective as means for improving the chemical convertibility. High chemical convertibility can be achieved when the reduced iron formed after annealing is present on the surface of the cold-rolled steel sheet at a coverage ratio of 40% or more.

The coverage ratio of the reduced iron can be determined by using a scanning electron microscope (SEM) and observing a reflected-electron image. In a reflected-electron image, an element having a higher atomic number appears in a lighter color. Thus, the portions covered with the reduced iron appear in a lighter color. In portions not covered with the reduced iron, Si oxides and the like are formed on a surface in the case of a high-strength cold-rolled steel sheet containing 0.6% or more of Si and appear in a dark color. Accordingly, the coverage ratio of the reduced iron can be determined by determining the area fraction of light-colored portions through image processing.

In order to form the reduced iron on the cold-rolled steel sheet surface at a coverage ratio of 40% or more, the oxidation amount of oxides on the cold-rolled steel sheet surface formed after the oxidation treatment is crucial. When oxides are formed on the steel sheet surface in an oxidation amount of 0.1 $g/m^2$ or more, the coverage ratio of the reduced iron can be adjusted to 40% or more. When the oxidation amount is less than 0.1 $g/m^2$, the coverage ratio of reduced iron may not be 40% or more and the chemical convertibility may be degraded. The "oxidation amount" refers to the amount of oxygen on the steel sheet surface after the oxidation treatment.

The oxidation amount can be measured by, for example, X-ray fluorescence analysis using reference materials.

The type of iron oxide formed is not particularly limited. Wustite (FeO), magnetite ($Fe_3O_4$), and hematite ($Fe_2O_3$) are mainly formed.

In the high-strength cold-rolled steel sheet of the embodiment of the present invention containing 0.60 or more of Si, oxides containing Si are formed at the same time as the iron oxides. The oxides containing Si are mainly $SiO_2$ and/or $(Fe,Mn)_2SiO_4$.

It has been found that, in the case where an oxidation amount of 0.1 $g/m^2$ or more is obtained after the oxidation treatment and $(Fe,Mn)_2SiO_4$ is formed, the reduced iron is formed on the steel sheet surface at a coverage ratio of 40% or more although the mechanism thereof is not clear. When only $SiO_2$ is formed as the oxide containing Si, the coverage ratio of the reduced iron is low and a coverage ratio of 40% or more may not be achieved. However, when $(Fe,Mn)_2SiO_4$ is formed as the oxide containing Si, the coverage ratio of the reduced iron increases despite the presence of a moderate amount of $SiO_2$, and a coverage ratio of 40% or more can be achieved.

The method for determining the species of these oxides is not particularly limited but infrared spectroscopy (IR) is effective. The species of oxides can be determined by detecting a peak at about 1230 $cm^{-1}$ for $SiO_2$ and a peak at about 1000 $cm^{-1}$ for $(Fe,Mn)_2SiO_4$.

Next, a method for producing a high-strength cold-rolled steel sheet according to aspects of the present invention is described.

A steel having the above described composition is hot-rolled, pickled, cold-rolled, oxidized, and annealed. The steps of the method for producing a cold-rolled steel sheet up to and not including the oxidation treatment are not particularly limited and any known production steps may be employed. In the oxidation treatment, first heating is conducted in an atmosphere having an oxygen concentration of 1000 ppm or more until the steel sheet temperature reaches 630° C. or higher and second heating is conducted in an atmosphere having an oxygen concentration of less than 1000 ppm until the steel sheet temperature reaches 700° C. or higher. The annealing is conducted by soaking the steel sheet in a furnace in a 1 to 10 vol % $H_2$+balance $N_2$ gas atmosphere having a dew point of −25° C. or lower.

The details are described below.

Hot-rolling may be conducted within typical ranges.

Coiling that follows the hot-rolling is preferably conducted at a temperature of 520° C. or higher and more preferably 580° C. or higher.

In aspects of the present invention, $(Fe,Mn)_2SiO_4$, which is an oxide that forms on the steel sheet surface after the oxidation treatment, is vital in improving the chemical convertibility. Thus the coiling temperature and the formation of $(Fe,Mn)_2SiO_4$ after the oxidation treatment were investigated. It has been found that when coiling is performed at a coiling temperature of 520° C. or higher, followed by cold-rolling, formation of $(Fe,Mn)_2SiO_4$ is promoted during the oxidation treatment and the chemical convertibility can be improved. Although the mechanism thereof is not clear, increasing the coiling temperature promotes oxidation of the steel sheet surface and particularly promotes oxidation of Si which is a readily oxidizable element. Presumably, because these oxides are eliminated before the cold-rolling, the concentration of solid solution Si on the steel sheet surface is lowered and more $(Fe,Mn)_2SiO_4$ is formed than $SiO_2$ during the oxidation treatment. From the viewpoint of promoting oxidation after coiling, the coiling temperature is more preferably 580° C. or higher.

Next, pickling and cold-rolling are performed.

Then the oxidation treatment is performed. This oxidation treatment is a critical requirement in aspects of the present invention. The oxidation treatment conducted under the following conditions will eventually control the oxidation amount of the oxides after the oxidation treatment and the coverage ratio of the reduced iron finally formed on the surface of the steel sheet. As a result, the chemical convertibility of a high-strength cold-rolled steel sheet containing 0.6% or more of Si can be improved.

In the oxidation treatment, first heating is conducted in an atmosphere having an oxygen concentration of 1000 ppm or more until the steel sheet temperature reaches 630° C. or higher and second heating is conducted in an atmosphere having an oxygen concentration of less than 1000 ppm until the steel sheet temperature reaches 700° C. or higher. As a result, an oxidation amount of 0.1 $g/m^2$ or more of oxides is formed on the steel sheet surface and $(Fe,Mn)_2SiO_4$ can be formed together with iron oxides.

The first heating in a heating furnace in an atmosphere having an oxygen concentration of 1000 ppm or more accelerates oxidation reactions due to a high-oxygen-concentration atmosphere and contributes to formation of $SiO_2$. It is effective to conduct heating until the steel sheet temperature reaches 630° C. or higher and more preferably 650° C. or higher.

When the oxygen concentration during this process is less than 1000 ppm, it is difficult to secure an oxidation amount of 0.1 $g/m^2$ or more.

The second heating in a furnace in an atmosphere having an oxygen concentration of less than 1000 ppm promotes formation of $(Fe,Mn)_2SiO_4$ instead of $SiO_2$ in a high-temperature, low-oxygen-concentration atmosphere. When the oxygen concentration during this process is 1000 ppm or more, formation of $(Fe,Mn)_2SiO_4$ does not occur, and the coverage ratio of the reduced iron will decrease as a result. Formation of $(Fe,Mn)_2SiO_4$ does not occur when the steel sheet temperature is low. Moreover, a low steel sheet temperature poses a problem in terms of securing the oxidation amount. Accordingly, the second heating is conducted in an atmosphere having an oxygen concentration of less than 1000 ppm until the steel sheet temperature reaches 700° C. or higher.

However, excessive oxidation leads to separation of Fe oxides in the following annealing step in a reducing atmosphere furnace and causes pickup defects to occur. Accordingly, the oxidation treatment is preferably conducted at a steel sheet temperature of 800° C. or less.

The heating furnace used in the oxidation treatment is not particularly limited but is preferably a heating furnace equipped with a direct firing burner. A direct firing burner heats a steel sheet by directly applying to a steel sheet surface a burner flame combusted by mixing air and a fuel such as coke oven gas (COG), i.e., a byproduct gas of ironwork. Since a direct firing burner can heat the steel sheet faster than radiation heating, the length of the heating furnace can be shortened or the line speed can be increased. When the air ratio is adjusted to 0.95 or more in the direct firing burner to increase the ratio of the air to the fuel, oxygen remains in the flame and can accelerate oxidation of the steel sheet. Accordingly, the oxygen concentration in the atmosphere can be controlled by adjusting the air ratio. The fuel of the direct firing burner may be COG, liquid natural gas (LNG), or the like. An infrared heating furnace may be used in the oxidation treatment.

The steel sheet subjected to the above-described oxidation treatment is annealed. This annealing is also a critical requirement of aspects of the present invention as the oxidation treatment. Annealing under the conditions described below allows control of the coverage ratio of the reduced iron finally formed on the surface and the chemical convertibility of a high-strength cold-rolled steel sheet containing 0.6% or more of Si can be improved.

Annealing is conducted in a furnace for soaking having a 1 to 10 vol % $H_2$+balance $N_2$ gas atmosphere and a dew point of −25° C. or less. The atmosphere gas introduced to the annealing furnace is a 1 to 10 vol % $H_2$+balance $N_2$ gas. The $H_2$ concentration in the atmosphere gas is limited to 1 to 10 vol % since at less than 1 vol %, not enough $H_2$ is present to reduce Fe oxides on the steel sheet surface and at more than 10 volt, reduction of the Fe oxides is saturated and excess $H_2$ is wasted.

The dew point is −25° C. or less. When the dew point exceeds −25° C., oxidation caused by oxygen of $H_2O$ in the furnace becomes significant and excessive internal oxidation of Si occurs.

As a result, an Fe-reducing atmosphere is created in the annealing furnace and Fe oxides formed by the oxidation treatment are reduced. During this process, some of the oxygen separated from Fe by reduction diffuses in the inside of the steel sheet and reacts with Si to give $SiO_2$ by internal oxidation. However, oxidation of Si in the steel sheet decreases the amount of Si oxides on the outermost surface of the steel sheet where the chemical conversion reactions occur. Thus, the chemical convertibility of the outermost surface of the steel sheet is improved.

Annealing is preferably conducted in a steel sheet temperature range of 750° C. to 900° C. from the viewpoint of adjusting the properties of the steel sheet. The soaking time is preferably 20 to 180 seconds.

The step after annealing differs depending on the steel type and is suitably selected. In aspects of the present invention, the step that follows the annealing is not particularly limited. For example, after annealing, the steel sheet may be cooled with gas, mist (mist of water mixed with air), water, or the like and tempered at 150° C. to 400° C. if desired. After the cooling or tempering, pickling with hydrochloric acid, sulfuric acid, or the like may be carried out to adjust the surface properties. The furnace used for soaking is not particularly limited. For example, a radiant tube-type heating furnace or an infrared heating furnace may be used.

EXAMPLE 1

A steel slab having chemical composition shown in Table 1 was heated to 1100° C. to 1200° C., hot-rolled, and coiled at 530° C. Then the hot-rolled steel sheet was pickled by a known method and cold-rolled to produce a steel sheet having a thickness of 1.5 mm. This steel sheet was subjected to an oxidation treatment under conditions shown in Table 2 using a heating furnace equipped with a direct firing burner. The direct firing burner used COG as a fuel and the oxygen concentration in the atmosphere was adjusted by varying the air ratio. The oxidation amount formed during this process was measured by X-ray fluorescence analysis. The infrared spectroscopy was conducted to analyze the oxides containing Si formed together with the iron oxides. The presence of $(Fe,Mn)_2SiO_4$ was confirmed by detecting the peak at around 1000 $cm^{-1}$ attributable to $(Fe,Mn)_2SiO_4$. Then heating and annealing were conducted under the conditions shown in Table 2 using an infrared heating furnace to obtain a high-strength cold-rolled steel sheet. The cooling after annealing was carried out with water, mist, or gas as shown in Table 2. In the case of water cooling, the sheet was cooled to the temperature of water and then re-heated to and retained at a retention temperature shown in Table 2. In the case of using mist and gas for cooling, the sheet was cooled to and held at a holding temperature shown in Table 2. The sheet was pickled with an acid shown in Table 2.

The pickling conditions were as follows:

Pickling with hydrochloric acid: Acid concentration of 1 to 20%, temperature of 30° C. to 90° C., and pickling time of 5 to 30 seconds.

Pickling with sulfuric acid: Acid concentration of 1 to 20%, temperature of 30° C. to 90° C., and pickling time of 5 to 30 seconds.

TABLE 1

Unit: mass %

| Steel type | C | Si | Mn | P | S | Al | N | Ti | Nb | V | Cr | Mo | Cu | Ni | B |
|---|---|---|---|---|---|---|---|---|---|---|---|---|---|---|---|
| A | 0.12 | 1.4 | 1.9 | 0.02 | 0.003 | 0.01 | 0.004 | — | — | — | — | — | — | — | — |
| B | 0.08 | 1.6 | 2.5 | 0.01 | 0.002 | 0.03 | 0.003 | 0.03 | — | — | — | — | — | — | 0.0013 |
| C | 0.15 | 0.9 | 1.6 | 0.02 | 0.005 | 0.02 | 0.005 | — | 0.05 | — | 0.35 | — | — | — | — |
| D | 0.05 | 0.6 | 1.1 | 0.03 | 0.001 | 0.05 | 0.004 | 0.01 | — | 0.05 | — | 0.12 | — | — | — |
| E | 0.20 | 1.5 | 2.5 | 0.02 | 0.002 | 0.01 | 0.007 | 0.05 | — | — | 0.01 | 0.01 | — | — | 0.0033 |
| F | 0.10 | 1.2 | 2.1 | 0.03 | 0.04 | 0.03 | 0.004 | — | 0.005 | 0.01 | — | — | — | — | 0.0003 |
| G | 0.04 | 1.2 | 1.2 | 0.01 | 0.002 | 0.03 | 0.005 | — | — | — | — | — | — | — | — |
| H | 0.25 | 1.3 | 2.9 | 0.02 | 0.003 | 0.04 | 0.003 | — | — | — | — | — | — | — | — |
| I | 0.15 | 0.4 | 1.6 | 0.02 | 0.001 | 0.03 | 0.003 | — | 0.02 | — | — | — | — | — | — |
| J | 0.09 | 2.9 | 1.8 | 0.01 | 0.002 | 0.45 | 0.002 | — | — | — | — | — | 0.4 | 0.2 | — |
| K | 0.08 | 3.2 | 1.6 | 0.03 | 0.004 | 0.04 | 0.003 | — | — | — | — | — | — | — | — |
| L | 0.06 | 1.8 | 0.9 | 0.02 | 0.004 | 0.03 | 0.003 | — | — | — | — | — | — | — | 0.0005 |
| M | 0.13 | 2.6 | 3.1 | 0.01 | 0.003 | 0.05 | 0.005 | — | — | — | — | — | — | — | — |
| N | 0.12 | 1.3 | 2.0 | 0.01 | 0.002 | 0.03 | 0.004 | — | — | — | — | — | — | — | 0.0008 |

The mechanical properties, the coverage ratio of the reduced iron, and the chemical convertibility of the high-strength cold-rolled steel sheet obtained as above were evaluated by the following methods.

The mechanical properties were tested in accordance with JIS Z 2241 using JIS No. 5 test pieces (JIS Z 2201) taken in a rolling direction and a perpendicular direction. After each test piece was put under 51 pre-strain, the test piece was baked at 170° C. for 20 minutes and the tensile strength ($TS_{BH}$) was again investigated as the strength after the baking treatment. The result was compared with the initial tensile strength ($TS_0$) and the difference was defined to be $\Delta TS$ ($TS_{BM}-TS_0$). The workability was evaluated on the basis of the product, TS×El The coverage ratio of the reduced iron was investigated through observation of a reflected-electron image using a scanning electron microscope (SEM). The acceleration voltage was 5 kV and arbitrarily selected 5 observation areas were observed at a 300× magnification. The observed image was binarized by image processing and the area fraction of light-colored portions was assumed to be the coverage ratio of the reduced iron.

The method for evaluating the chemical convertibility is as follows.

A conversion treatment solution (PALBOND L3080 (registered trade mark)) available from Nihon Parkerizing Co., Ltd. was used and the chemical conversion treatment was carried out by the following method.

The steel sheet was degreased with a degreasing solution, FINE CLEANER (registered trade mark) available from Nihon Parkerizing Co., Ltd., and washed with water, and the surface was conditioned with a surface conditioning solution, PREPALENE Z (registered trade mark) available from Nihon Parkerizing Co., Ltd., for 30 seconds. The steel sheet was then immersed in a 43° C. chemical conversion treatment solution (PALBOND L3080) for 120 seconds, washed with water, and dried by applying hot air.

Chemical conversion coatings were observed with a scanning electron microscope (SEM) at a 500× magnification in randomly selected 5 observation areas and the area fraction of the portions not covered with the chemical conversion coatings (hereinafter referred to as "uncovered area fraction") was measured through image processing. Evaluation was conducted on the basis of the uncovered area fraction. Ratings AA and A are acceptable.

AA: 50 or less

A: more than 5% but not more than 10%

F: more than 10%

The results and the production conditions are shown in Table 2.

TABLE 2

| | | Oxidation treatment using direct firing burner | | | Oxides after oxidation treatment | | Soaking in reducing atmosphere furnace | | | | |
|---|---|---|---|---|---|---|---|---|---|---|---|
| No. | Steel type | First stage Oxygen con-centration (ppm) | Second stage Oxygen concentration (ppm) | Furnace exit-side temperature (° C.) | Oxidation amount (g/m2) | (Fe,Mn)2SiO4 Peak detected: ○ No peak detected: x | Hydrogen concentration (vol %) | Dew point (° C.) | Soaking temperature (° C.) | Soaking time (sec) | Cooling conditions |
| 1 | A | 5000 | 500 | 750 | 0.34 | ○ | 5% | −50 | 830 | 30 | Water |
| 2 | A | 1500 | 500 | 730 | 0.28 | ○ | 5% | −50 | 830 | 30 | Water |
| 3 | A | 20000 | 700 | 720 | 0.43 | ○ | 5% | −50 | 830 | 30 | Water |
| 4 | A | 5000 | 250 | 650 | 0.07 | x | 5% | −50 | 830 | 30 | Water |
| 5 | A | 10000 | 1500 | 700 | 0.25 | x | 5% | −50 | 830 | 30 | Water |
| 6 | A | 720 | 250 | 750 | 0.06 | x | 5% | −50 | 830 | 30 | Water |
| 7 | B | 5000 | 500 | 780 | 0.45 | ○ | 8% | −40 | 820 | 30 | Gas |
| 8 | C | 5000 | 500 | 700 | 0.31 | ○ | 7% | −38 | 820 | 20 | Mist |
| 9 | D | 5000 | 700 | 700 | 0.35 | ○ | 4% | −25 | 800 | 60 | Water |
| 10 | E | 5000 | 250 | 800 | 0.47 | ○ | 8% | −30 | 750 | 120 | Gas |
| 11 | F | 10000 | 700 | 800 | 0.44 | ○ | 8% | −30 | 850 | 30 | Mist |
| 12 | F | 15000 | 500 | 680 | 0.08 | x | 8% | −30 | 850 | 30 | Mist |
| 13 | I | 10000 | 750 | 700 | 0.18 | ○ | 5% | −30 | 860 | 150 | Water |
| 14 | M | 10000 | 300 | 800 | 0.28 | ○ | 4% | −35 | 810 | 80 | Water |
| 15 | A | 1500 | 400 | 700 | 0.15 | ○ | 0% | −30 | 850 | 130 | Water |
| 16 | B | 5000 | 500 | 800 | 0.44 | ○ | 4% | −15 | 840 | 30 | Water |
| 17 | C | 15000 | 750 | 800 | 0.48 | ○ | 6% | −32 | 770 | 60 | Water |
| 18 | D | 5000 | 600 | 730 | 0.16 | ○ | 5% | −50 | 830 | 30 | Water |
| 19 | N | 5000 | 500 | 780 | 0.33 | ○ | 5% | −50 | 830 | 30 | Water |

| | | Soaking in reducing atmosphere furnace | | | Mechanical properties | | | | | Coverage ratio of | Area fraction of portions not covered with chemical | |
|---|---|---|---|---|---|---|---|---|---|---|---|---|
| No. | Steel type | Holding temperature (° C.) | Holding time (sec) | Pickling | YS (MPa) | TS (MPa) | El (%) | TS × El (Mpa · %) | ΔTS (MPa) | reduced iron (%) | conversion coating | |
| 1 | A | — | — | Hydrochloric acid | 840 | 1050 | 19.0 | 19920 | 40 | 80 | A | Example |
| 2 | A | — | — | Sulfuric acid | 820 | 1030 | 18.8 | 19350 | 40 | 60 | A | Example |
| 3 | A | 210 | 370 | Hydrochloric acid | 800 | 1000 | 18.5 | 18470 | 10 | 95 | AA | Example |
| 4 | A | 210 | 350 | Sulfuric acid | 830 | 1040 | 18.2 | 18960 | 20 | 30 | F | Comparative Example |
| 5 | A | 360 | 610 | Hydrochloric acid | 820 | 1020 | 18.7 | 19030 | 40 | 50 | F | Comparative Example |
| 6 | A | 280 | 420 | Hydrochloric acid | 820 | 1000 | 18.5 | 18500 | 30 | 25 | F | Comparative Example |
| 7 | B | — | — | — | 650 | 810 | 23.7 | 19190 | 10 | 80 | AA | Example |
| 8 | C | — | — | Hydrochloric acid | 900 | 1120 | 17.8 | 19920 | 30 | 65 | A | Example |
| 9 | D | 270 | 500 | Hydrochloric acid | 550 | 690 | 27.8 | 19190 | 40 | 80 | A | Example |
| 10 | E | 310 | 190 | — | 980 | 1230 | 14.7 | 18050 | 10 | 95 | AA | Example |
| 11 | F | — | — | Hydrochloric acid | 560 | 700 | 26.8 | 18760 | 0 | 90 | AA | Example |
| 12 | F | 200 | 810 | — | 640 | 800 | 23.6 | 18910 | 10 | 30 | F | Comparative Example |
| 13 | I | 270 | 200 | Hydrochloric acid | 750 | 940 | 17.4 | 16310 | 30 | 45 | A | Comparative Example |
| 14 | M | — | — | Sulfuric acid | 1040 | 1300 | 8.5 | 11050 | 20 | 40 | F | Comparative Example |
| 15 | A | 270 | 880 | Hydrochloric acid | 800 | 1000 | 19.0 | 18960 | 40 | 20 | F | Comparative Example |

TABLE 2-continued

| | | | | | | | | | | | | |
|---|---|---|---|---|---|---|---|---|---|---|---|---|
| 16 | B | — | — | Sulfuric acid | 640 | 800 | 23.8 | 19030 | 10 | 75 | F | Comparative Example |
| 17 | C | 180 | 510 | Hydrochloric acid | 920 | 1150 | 16.7 | 19190 | 30 | 80 | AA | Example |
| 18 | D | 380 | 810 | — | 600 | 750 | 26.6 | 19920 | 40 | 50 | A | Example |
| 19 | N | 190 | 500 | Hydrochloric acid | 750 | 1150 | 16.7 | 19190 | 110 | 65 | AA | Example |

Table 2 shows that in Examples of the present invention, the tensile strength (TS) is 590 MPa or more and the strength-elongation balance (TS×El) is 18000 MPa·% or more. Thus, a high strength, high workability, and high chemical convertibility were achieved. In contrast, Comparative Examples are poor in chemical convertibility.

EXAMPLE 2

A steel slab having chemical composition shown in Table 1 was heated to 1100° C. to 1200° C., hot-rolled, and coiled at 530° C. Then the hot-rolled steel sheet was pickled by a known method and cold-rolled to produce a steel sheet having a thickness of 1.5 mm. The steel sheet was oxidized under the conditions shown in Table 3 in an infrared heating furnace. The oxidation amount and the oxides formed during this process were analyzed as in Example 1. Then the steel sheet was heated and annealed in the infrared heating furnace to obtain a high-strength cold-rolled steel sheet. Cooling after the annealing was conducted with water, mist, or gas as shown in Table 3. In the case of cooling with water, the sheet was cooled to the temperature of water and re-heated to and held at the holding temperature shown in Table 3. In the case of heating with mist or gas, the steel sheet was cooled to and held at the holding temperature shown in Table 3. Then the pickling treatment was conducted with an acidic solution shown in Table 3.

The mechanical properties, the coverage ratio of the reduced iron, and the chemical convertibility of the resulting high-strength cold-rolled steel sheet obtained as above were evaluated as in Example 1.

The results obtained and the production conditions are shown in Table 3.

TABLE 3

| | | Heating in infrared heating furnace | | | Oxides after oxidation treatment | | Soaking in reducing atmosphere furnace | | | | |
|---|---|---|---|---|---|---|---|---|---|---|---|
| No. | Steel type | First stage Oxygen con-centration (ppm) | Second stage Oxygen concentration (ppm) | Furnace exit-side temperature (° C.) | Oxidation amount (g/m2) | (Fe,Mn)2SiO4 Peak detected: ○ No peak detected: x | Hydrogen concentration (vol %) | Dew point (° C.) | Soaking temperature (° C.) | Soaking time (sec) | Cooling conditions |
| 1 | A | 5000 | 700 | 670 | 0.08 | x | 6% | −42 | 830 | 30 | Water |
| 2 | A | 1500 | 700 | 730 | 0.35 | ○ | 6% | −42 | 830 | 30 | Water |
| 3 | A | 3000 | 700 | 800 | 0.44 | ○ | 6% | −42 | 830 | 30 | Water |
| 4 | A | 700 | 650 | 700 | 0.07 | x | 6% | −42 | 830 | 30 | Water |
| 5 | A | 2000 | 2000 | 750 | 0.33 | x | 6% | −42 | 830 | 30 | Water |
| 6 | A | 5000 | 800 | 460 | 0.02 | x | 6% | −42 | 830 | 30 | Water |
| 7 | B | 10000 | 500 | 800 | 0.42 | ○ | 7% | −38 | 820 | 20 | Gas |
| 8 | B | 5000 | 500 | 700 | 0.36 | ○ | 7% | −38 | 820 | 20 | Gas |
| 9 | C | 15000 | 500 | 760 | 0.38 | ○ | 5% | −30 | 800 | 60 | Mist |
| 10 | C | 10000 | 800 | 780 | 0.43 | ○ | 5% | −30 | 800 | 60 | Mist |
| 11 | D | 2000 | 500 | 700 | 0.33 | ○ | 3% | −25 | 800 | 120 | Water |
| 12 | E | 5000 | 200 | 770 | 0.37 | ○ | 10% | −45 | 800 | 100 | Gas |
| 13 | F | 5000 | 600 | 760 | 0.41 | ○ | 7% | −35 | 850 | 120 | Mist |
| 14 | F | 1500 | 600 | 650 | 0.09 | x | 7% | −38 | 820 | 20 | Mist |
| 15 | G | 5000 | 600 | 800 | 0.46 | ○ | 6% | −42 | 830 | 20 | Water |
| 16 | H | 10000 | 500 | 700 | 0.22 | ○ | 6% | −42 | 780 | 60 | Gas |
| 17 | I | 3000 | 300 | 760 | 0.37 | ○ | 7% | −38 | 830 | 90 | Gas |
| 18 | J | 2000 | 400 | 780 | 0.23 | ○ | 7% | −38 | 890 | 100 | Water |
| 19 | K | 10000 | 500 | 700 | 0.09 | ○ | 5% | −30 | 820 | 140 | Water |
| 20 | L | 5000 | 500 | 770 | 0.37 | ○ | 5% | −30 | 750 | 50 | Water |
| 21 | M | 5000 | 500 | 760 | 0.29 | ○ | 3% | −25 | 800 | 120 | Gas |
| 22 | N | 5000 | 750 | 730 | 0.28 | ○ | 10% | −45 | 780 | 50 | Water |
| 23 | D | 500 | 600 | 800 | 0.05 | x | 7% | −35 | 750 | 40 | Water |

| | | Soaking in reducing atmosphere furnace | | | Mechanical properties | | | | | Coverage | Area fraction of portions not covered with | |
|---|---|---|---|---|---|---|---|---|---|---|---|---|
| No. | Steel type | Holding temperature (° C.) | Holding time (sec) | Pickling | YS (MPa) | TS (MPa) | El (%) | TS × El (Mpa · %) | ΔTS (MPa) | ratio of reduced iron (%) | chemical conversion coating | |
| 1 | A | — | — | Hydrochloric acid | 810 | 1020 | 18.2 | 18600 | 20 | 20 | F | Comparative Example |
| 2 | A | — | — | Sulfuric acid | 800 | 1010 | 18.9 | 19120 | 0 | 60 | A | Example |

TABLE 3-continued

| | | | | | | | | | | | | |
|---|---|---|---|---|---|---|---|---|---|---|---|---|
| 3 | A | 310 | 290 | Hydrochloric acid | 810 | 1020 | 18.5 | 18820 | 40 | 95 | AA | Example |
| 4 | A | 350 | 90 | Sulfuric acid | 820 | 1030 | 18.7 | 19230 | 40 | 30 | F | Comparative Example |
| 5 | A | 300 | 200 | Sulfuric acid | 800 | 1000 | 18.2 | 18200 | 30 | 25 | F | Comparative Example |
| 6 | A | 220 | 250 | — | 840 | 1050 | 18.5 | 19470 | 40 | 15 | F | Comparative Example |
| 7 | B | 320 | 650 | — | 670 | 840 | 23.0 | 19360 | 10 | 80 | AA | Example |
| 8 | B | — | — | Hydrochloric acid | 680 | 860 | 22.5 | 19390 | 20 | 65 | A | Example |
| 9 | C | 360 | 670 | — | 830 | 1040 | 17.5 | 18250 | 40 | 80 | AA | Example |
| 10 | C | — | — | Hydrochloric acid | 800 | 1000 | 19.6 | 19570 | 10 | 95 | AA | Example |
| 11 | D | 240 | 900 | Sulfuric acid | 600 | 750 | 26.5 | 19910 | 30 | 70 | A | Example |
| 12 | E | — | — | — | 1000 | 1250 | 15.5 | 19430 | 40 | 80 | AA | Example |
| 13 | F | 150 | 460 | Hydrochloric acid | 790 | 990 | 19.0 | 18830 | 10 | 85 | AA | Example |
| 14 | F | 360 | 330 | Sulfuric acid | 820 | 1035 | 17.9 | 18500 | 0 | 35 | F | Comparative Example |
| 15 | G | 370 | 450 | — | 420 | 530 | 34.5 | 18260 | 10 | 20 | AA | Comparative Example |
| 16 | H | 180 | 100 | — | 1200 | 1500 | 12.2 | 18290 | 30 | 75 | AA | Example |
| 17 | I | 290 | 950 | Hydrochloric acid | 800 | 1000 | 14.3 | 14300 | 30 | 80 | A | Comparative Example |
| 18 | J | 330 | 570 | Hydrochloric acid | 680 | 850 | 25.0 | 21250 | 0 | 50 | A | Example |
| 19 | K | 320 | 750 | Sulfuric acid | 680 | 860 | 12.5 | 10750 | 10 | 65 | F | Comparative Example |
| 20 | L | 260 | 620 | Sulfuric acid | 430 | 490 | 39.0 | 19110 | 40 | 75 | AA | Comparative Example |
| 21 | M | 350 | 140 | — | 1150 | 1350 | 8.4 | 11340 | 40 | 55 | A | Comparative Example |
| 22 | N | 210 | 140 | Hydrochloric acid | 800 | 1010 | 19.5 | 19740 | 120 | 75 | A | Example |
| 23 | D | 340 | 370 | Sulfuric acid | 820 | 1030 | 18.4 | 18980 | 10 | 30 | F | Comparative Example |

Table 3 shows that according to Examples of the invention, the tensile strength (TS) is 590 MPa or more and TS×El is 18000 MPa·% or more. Thus, a high strength, high workability, and high chemical convertibility were achieved.

In contrast, Comparative Examples are poor in at least one of strength and chemical convertibility.

EXAMPLE 3

A steel slab having chemical composition shown in Table 1 was hot-rolled by a known method and coiled at a coiling temperature shown in Table 4. Then the hot-rolled steel sheet was pickled and cold-rolled to produce a steel sheet having a thickness of 1.5 mm. The steel sheet was passed through a continuous annealing line equipped with a pre-heating furnace, a heating furnace equipped with a direct firing burner, a radiant-tube-type soaking furnace, and a cooling furnace to conduct heating and annealing. As a result, a high-strength cold-rolled steel sheet was obtained. The heating furnace equipped with the direct firing burner was divided into 4 zones and all the zones had the same length. The direct firing burner used COG as a fuel. The oxygen concentration in the atmosphere was adjusted by varying the air ratios in the first stage (three zones) and second stage (one zone) of the heating furnace. Cooling after annealing was conducted with water, mist, or gas, as shown in Table 4. In the case of cooling with water, the sheet was cooled to the temperature of water and re-heated to and held at the holding temperature shown in Table 4. In the case of heating with mist or gas, the steel sheet was cooled to and held at the holding temperature shown in Table 4. Then the pickling was conducted with an acidic solution shown in Table 4.

The mechanical properties, the coverage ratio of the reduced iron, and the chemical convertibility of the resulting high-strength cold-rolled steel sheet obtained as above were evaluated as in Example 1.

The results obtained and the production conditions are shown in Table 4.

TABLE 4

| | | | Heating with furnace equipped with direct firing burner | | | Soaking in reducing atmosphere furnace | | | | | |
|---|---|---|---|---|---|---|---|---|---|---|---|
| | | Hot-roll | First stage | Second stage | Furnace exit- | | | | | | |
| No. | Steel type | coiling temperature (° C.) | Oxygen concentration (ppm) | Oxygen concentration (ppm) | side temperature (° C.) | Hydrogen concentration (vol %) | Dew point (° C.) | Soaking temperature (° C.) | Soaking time (sec) | Cooling conditions | Holding temperature (° C.) |
| 1 | A | 450 | 5000 | 700 | 680 | 10% | −45 | 830 | 30 | Water | — |
| 2 | A | 500 | 5000 | 600 | 730 | 10% | −45 | 830 | 30 | Water | — |
| 3 | A | 520 | 10000 | 600 | 760 | 10% | −45 | 830 | 30 | Water | 320 |
| 4 | A | 570 | 10000 | 600 | 480 | 10% | −45 | 830 | 30 | Water | 380 |

TABLE 4-continued

| | | | | | | | | | | | |
|---|---|---|---|---|---|---|---|---|---|---|---|
| 5 | A | 580 | 10000 | 600 | 750 | 10% | −45 | 830 | 30 | Water | 250 |
| 6 | A | 620 | 10000 | 600 | 700 | 10% | −45 | 830 | 30 | Water | 390 |
| 7 | B | 550 | 10000 | 500 | 780 | 8% | −40 | 820 | 30 | Gas | 350 |
| 8 | C | 550 | 5000 | 500 | 700 | 7% | −38 | 820 | 20 | Mist | — |
| 9 | D | 520 | 6000 | 500 | 700 | 4% | −25 | 800 | 60 | Water | 160 |
| 10 | E | 520 | 3000 | 500 | 800 | 8% | −30 | 750 | 120 | Gas | — |
| 11 | F | 500 | 3000 | 500 | 760 | 9% | −33 | 850 | 30 | Mist | 270 |
| 12 | F | 580 | 5000 | 500 | 650 | 9% | −33 | 850 | 30 | Mist | 260 |
| 13 | A | 580 | 5000 | 500 | 700 | 5% | −25 | 860 | 160 | Water | — |
| 14 | B | 600 | 5000 | 500 | 780 | 6% | −30 | 830 | 110 | Water | 300 |
| 15 | C | 600 | 5000 | 500 | 700 | 0% | −33 | 860 | 80 | Water | 150 |
| 16 | D | 600 | 5000 | 500 | 700 | 4% | −20 | 800 | 40 | Water | 230 |

| | | Soaking in reducing atmosphere furnace | | Mechanical properties | | | | | Coverage ratio of | Area fraction of portions not covered with chemical | |
|---|---|---|---|---|---|---|---|---|---|---|---|
| No. | Steel type | Holding time (sec) | Pickling | YS (MPa) | TS (MPa) | El (%) | TS × El (Mpa · %) | ΔTS (MPa) | reduced iron (%) | conversion coating | |
| 1 | A | — | Hydrochloric acid | 810 | 1010 | 19.3 | 19520 | 40 | 30 | F | Comparative Example |
| 2 | A | — | Sulfuric acid | 830 | 1030 | 19.2 | 19820 | 40 | 40 | A | Example |
| 3 | A | 540 | Sulfuric acid | 820 | 1020 | 18.0 | 18350 | 40 | 75 | AA | Example |
| 4 | A | 100 | Sulfuric acid | 790 | 990 | 20.1 | 19920 | 10 | 20 | F | Comparative Example |
| 5 | A | 590 | Sulfuric acid | 820 | 1020 | 19.0 | 19350 | 20 | 80 | AA | Example |
| 6 | A | 440 | Sulfuric acid | 810 | 1010 | 18.3 | 18470 | 40 | 95 | AA | Example |
| 7 | B | 430 | — | 660 | 830 | 22.8 | 18960 | 10 | 85 | AA | Example |
| 8 | C | — | Hydrochloric acid | 980 | 1230 | 15.5 | 19030 | 30 | 70 | A | Example |
| 9 | D | 150 | Hydrochloric acid | 650 | 810 | 23.7 | 19190 | 40 | 60 | A | Example |
| 10 | E | — | Hydrochloric acid | 1070 | 1340 | 14.9 | 19920 | 10 | 75 | AA | Example |
| 11 | F | 270 | — | 700 | 880 | 21.8 | 19190 | 0 | 40 | A | Example |
| 12 | F | 510 | Sulfuric acid | 740 | 920 | 19.6 | 18050 | 10 | 25 | F | Comparative Example |
| 13 | A | — | — | 800 | 1000 | 18.8 | 18760 | 30 | 80 | AA | Example |
| 14 | B | 740 | Sulfuric acid | 680 | 850 | 22.2 | 18910 | 30 | 75 | AA | Example |
| 15 | C | 160 | Hydrochloric acid | 1000 | 1250 | 15.2 | 19020 | 0 | 80 | AA | Example |
| 16 | D | 360 | Sulfuric acid | 520 | 650 | 27.9 | 18120 | 10 | 90 | AA | Example |

Table 4 shows that according to Examples of the invention, the tensile strength (TS) is 590 MPa or more and TS×El is 18000 MPa·% or more. Thus, a high strength, high workability, and high chemical convertibility were achieved. In contrast, Comparative Examples are poor in chemical convertibility.

Since a high-strength cold-rolled steel sheet of aspects of the present invention has a high strength and high chemical convertibility, it can be used as a cold-rolled steel sheet that helps achieve weight-reduction and higher strength of automobile bodies. The high-strength cold-rolled steel sheet can also be used in a wide range of fields other than automobiles, such as home electric appliances and building materials.

The invention claimed is:

1. A high-strength cold-rolled steel sheet comprising, in terms of percent by mass, a composition of C: 0.05 to 0.3%, Si: 0.6 to 3.0%, Mn: 1.0 to 3.0%, P: 0.1% or less, S: 0.05% or less, Al: 0.01 to 1%, N: 0.01% or less, and the balance being Fe and unavoidable impurities, wherein a coverage ratio of reduced iron oxides on a steel sheet surface is 40% or more, the iron oxides comprising $(Fe,Mn)_2SiO_4$.

2. The high-strength cold-rolled steel sheet according to claim 1, further comprising, in terms of percent by mass, at least one of Cr: 0.01 to 1%, Mo: 0.01 to 1%, Ni: 0.01 to 1%, and Cu: 0.01 to 1%.

3. The high-strength cold-rolled steel sheet according to claim 1, further comprising, in terms of percent by mass, at least one of TI: 0.001 to 0.1%, Nb: 0.001 to 0.1%, and V: 0.001 to 0.1%.

4. The high-strength cold-rolled steel sheet according to claim 1, further comprising, in terms of percent by mass, B: 0.0003 to 0.005%.

5. A method for producing a high-strength cold-rolled steel sheet, comprising sequentially conducting hot-rolling, pickling, cold-rolling, an oxidation treatment, and annealing on steel comprising, in terms of percent by mass, a composition of C: 0.05 to 0.3%, Si: 0.6 to 3.0%, Mn: 1.0 to 3.0%, P: 0.1% or less, S: 0.5% or less, Al: 0.01 to 1%, N: 0.01% or less, and the balance being Fe and unavoidable impurities, wherein, in the oxidation treatment, first heating is conducted on a steel sheet in an atmosphere with an oxygen concentration of 1000 ppm or more until a steel sheet temperature reaches 630° C. or higher, and second heating is conducted on the steel sheet in an atmosphere with an oxygen concentration of less than 1000 ppm until a steel sheet temperature reaches 700° C. or higher; and in the annealing, soaking are conducted in a furnace in a 1 to 10 vol % $H_2$+balance $N_2$ gas atmosphere with a dew point of −25° C. or less.

6. The method for producing a high-strength cold-rolled steel sheet according to claim 5, wherein the second heating in the oxidation treatment is carried out at a steel sheet temperature of 800° C. or less.

7. The method for producing a high-strength cold-rolled steel sheet according to claim 5, wherein, after the hot-rolling, the steel sheet Is coiled at a coiling temperature of 520° C. or higher.

8. The method for producing a high-strength cold-rolled steel sheet according to claim 5, wherein, after the hot-rolling, the steel sheet is coiled at a coiling temperature of 580° C. or higher.

9. The high-strength cold-rolled steel sheet according to claim 2, further comprising, in terms of percent by mass, at least one of Ti: 0.001 to 0.1%, Nb: 0.001 to 0.1%, and V: 0.001 to 0.1%.

10. The high-strength cold-rolled steel sheet according to claim 2, further comprising, in terms of percent by mass, B: 0.0003 to 0.005%.

11. The high-strength cold-rolled steel sheet according to claim 3, further comprising, in terms of percent by mass, B: 0.0003 to 0.005%.

12. A method for producing a high-strength cold-rolled steel sheet, comprising sequentially conducting hot-rolling, pickling, cold-rolling, an oxidation treatment, and annealing on steel comprising, in terms of percent by mass, a composition C: 0.05 to 0.3%, Si: 0.6 to 3.0%, Mn: 1.0 to 3.0%, P: 0.1% or less, S: 0.05% or less, Al: 0.01 to 1%, N: 0.01% or less, and the balance being Fe and unavoidable impurities, and further comprising, in terms of percent by mass, at least one of Cr: 0.01 to 1%, Mo: 0.01 to 1%, Ni: 0.01 to 1%, and Cu: 0.01 to 1%, wherein, in the oxidation treatment, first heating is conducted on a steel sheet in an atmosphere with an oxygen concentration of 1000 ppm or more until a steel sheet temperature reaches 630° C. or higher, and second heating is conducted on the steel sheet in an atmosphere with an oxygen concentration of less than 1000 ppm until a steel sheet temperature reaches 700° C. or higher; and in the annealing, soaking are conducted in a furnace in a 1 to 10 vol % $H_2$+balance $N_2$ gas atmosphere with a dew point of −25° C. or less.

13. A method for producing a high-strength cold-rolled steel sheet, comprising sequentially conducting hot-rolling, pickling, cold-rolling, an oxidation treatment, and annealing on steel comprising, in terms of percent by mass, a composition of C: 0.05 to 0.3%, Si: 0.6 to 3.0%, Mn: 1.0 to 3.0%, P: 0.1% or less, S: 0.05% or less, Al: 0.01 to 1%, N: 0.01% or less, and the balance being Fe and unavoidable impurities, and further comprising, in terms of percent by mass, at least one of Ti: 0.001 to 0.1%, Nb: 0.001 to 0.1%, and V: 0.001 to 0.1%, wherein, in the oxidation treatment, first heating is conducted on a steel sheet in an atmosphere with an oxygen concentration of 1000 ppm or more until a steel sheet temperature reaches 630° C. or higher, and second heating is conducted on the steel sheet in an atmosphere with an oxygen concentration of less than 1000 ppm until a steel sheet temperature reaches 700° C. or higher; and in the annealing, soaking are conducted in a furnace in a 1 to 10 vol % $H_2$+balance $N_2$ gas atmosphere with a dew point of −25° C. or less.

14. A method for producing a high-strength cold-rolled steel sheet, comprising sequentially conducting hot-rolling, pickling, cold-rolling, an oxidation treatment, and annealing on steel comprising, in terms of percent by mass, a composition of C: 0.05 to 0.3%, Si: 0.6 to 3.0%, Mn: 1.0 to 3.0%, P: 0.1% or less, S: 0.05% or less, Al: 0.01 to 1%, N: 0.01% or less, and the balance being Fe and unavoidable impurities, and further comprising, in terms of percent by mass, B: 0.0003 to 0.005%, wherein, in the oxidation treatment, first heating is conducted on a steel sheet in an atmosphere with an oxygen concentration of 1000 ppm or more until a steel sheet temperature reaches 630° C. or higher, and second heating is conducted on the steel sheet in an atmosphere with an oxygen concentration of less than 1000 ppm until a steel sheet temperature reaches 700° C. or higher; and in the annealing, soaking are conducted in a furnace in a 1 to 10 vol % $H_2$+balance $N_2$ gas atmosphere with a dew point of −25° C. or less.

15. The method for producing a high-strength cold-rolled steel sheet according to claim 6, wherein, after the hot-rolling, the steel sheet is coiled at a coiling temperature of 520° C. or higher.

16. The method for producing a high-strength cold-rolled steel sheet according to claim 6, wherein, after the hot-rolling, the steel sheet is coiled at a coiling temperature of 580° C. or higher.

* * * * *